US007422320B2

(12) United States Patent
Sugiura

(10) Patent No.: US 7,422,320 B2
(45) Date of Patent: Sep. 9, 2008

(54) RECORDING MEDIUM CONVEYING DEVICE WITH NIPPING FORCE CONTROL

(75) Inventor: Toshio Sugiura, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/809,438

(22) Filed: Mar. 26, 2004

(65) Prior Publication Data

US 2004/0252176 A1 Dec. 16, 2004

(30) Foreign Application Priority Data

Mar. 31, 2003 (JP) ..... 2003-096020

(51) Int. Cl.
*B41J 13/02* (2006.01)

(52) U.S. Cl. ..... 347/104; 400/624; 400/636.3; 271/273; 271/274

(58) Field of Classification Search ..... 271/272, 271/273, 274; 347/104; 400/624, 636.3
See application file for complete search history.

(56) References Cited

U.S. PATENT DOCUMENTS 4,053,224 A * 10/1977 Burkard et al. ..... 355/76
4,619,451 A * 10/1986 Dodge ..... 271/274
5,106,071 A * 4/1992 Graham ..... 271/116
5,129,749 A * 7/1992 Sato ..... 400/639
5,182,861 A * 2/1993 Suzuki et al. ..... 33/18.1
5,580,042 A * 12/1996 Taniguro et al. ..... 271/274
5,870,114 A 2/1999 Numata et al.
6,126,347 A * 10/2000 Sakaino et al. ..... 400/642
6,343,787 B1 * 2/2002 Kato et al. ..... 271/274
6,712,357 B1 * 3/2004 Tranquilla ..... 271/273

FOREIGN PATENT DOCUMENTS

| | | |
|---|---|---|
| JP | A 57-151755 | 9/1982 |
| JP | U 63-52841 | 4/1988 |
| JP | Y2 63-13012 | 4/1988 |
| JP | A 3-90378 | 4/1991 |
| JP | A 05-221103 | 8/1993 |
| JP | A 06-064258 | 3/1994 |
| JP | A 07-025007 | 1/1995 |
| JP | A 2002-080140 | 3/2002 |
| JP | A 2002-154701 | 5/2002 |
| JP | A 2002-284388 | 10/2002 |
| JP | A 2002-347974 | 12/2002 |

* cited by examiner

*Primary Examiner*—Jill E. Culler
(74) *Attorney, Agent, or Firm*—Oliff & Berridge, PLC

(57) ABSTRACT

A recording medium conveying device that conveys a recording medium to a recording area, includes a pair of first conveyor rollers that are provided upstream of the recording area and convey a recording medium by nipping the recording medium therebetween, a detector that detects a position of the recording medium, a nipping force changing unit that changes the nipping force of the pair of first conveyor rollers, and a controller that controls an operation of the nipping force changing unit in accordance with the position of the recording medium detected by the detector.

23 Claims, 6 Drawing Sheets

RECORDING MEDIUM CONVEYING DEVICE WITH NIPPING FORCE CONTROL

This application claims priority from JP 2003-096020, filed Mar. 31, 2003, and incorporates the contents thereof by reference thereto.

BACKGROUND OF THE INVENTION

1. Field of Invention

The invention relates to a recording medium conveying device that conveys a recording medium by nipping the recording medium, and an image forming apparatus including the recording medium conveying device.

2. Description of Related Art

In a conventional image forming apparatus, that forms an image onto a recording medium by ejecting ink droplets from nozzles of an ink jet recording head, the recording medium is intermittently (step by step) moved in a sub-scanning direction by a predetermined distance. While the recording medium is not intermittently moved, a carriage having the recording head is moved in a main scanning direction to form an image in a predetermined area.

In the image forming apparatus, a pair of upstream conveyor rollers and a pair of downstream conveyor rollers are provided upstream and downstream of the recording head in a recording medium conveying direction, respectively. The recording medium is nipped by the pairs of upstream and downstream conveyor rollers and is moved in the sub-scanning direction by intermittently driving both the pairs of conveyor rollers.

Especially in a case where a recording medium is thick, a load that is imposed on the recording medium from a nipping point of the upstream conveyor rollers suddenly becomes zero when a trailing edge of the recording medium is released from the upstream conveyor rollers. With the change of the load, the trailing edge of the recording medium is suddenly pushed by the upstream conveyor rollers, resulting in the recording medium being excessively conveyed against the nipping force of the downstream conveyor rollers. Because of this situation, an image dropout (an image is severed into several pieces) occurs in the recording image in a sheet conveying direction, thereby degrading image quality.

Japanese Laid-Open Patent Publication No. 3-90378 discloses a medium processing device wherein a printing unit is provided between a pair of upstream conveyor rollers and a pair of downstream conveyor rollers, a first detector is provided near the upstream conveyor rollers, and a second detector is provided near the downstream conveyor rollers. Each of a driven roller of the upstream and downstream conveyor rollers includes an engaging and disengaging device (solenoid) to selectively engage and disengage the driven rollers with and from respective drive rollers.

Based on the detection of a leading edge of the recording medium by the first or second detectors, the leading edge of the recording medium is positioned between the drive roller and driven rollers, which are separated from one another. Then, the driven roller is brought into contact with the drive roller so as to be pressed against the drive roller, and the recording medium is conveyed in a downstream direction. Based on the detection of the leading edge and the trailing edge of the recording medium by the first detector, a length of the recording medium is obtained. After that, the leading edge of the recording medium is positioned in a printing position by rotating the -drive rollers in a reverse direction to convey the recording medium in the reverse direction. Then, the upstream conveyor rollers are rotated in a normal direction to perform printing on the recording medium. As the second detector detects the leading edge of the recording medium, the solenoid activates so that the recording medium is nipped by the drive roller and the driven roller of the downstream conveyor rollers and another solenoid activates to disengage the driven roller from the drive roller of the upstream conveyor rollers. After that, the recording medium processing device continues the printing operation in a printing area while the recording medium is nipped by the downstream conveyor rollers.

SUMMARY OF THE INVENTION

However, according to Japanese Laid-Open Patent Publication No. 3-90378, the upstream and downstream conveyor rollers need to be rotated in the normal direction and the reverse direction in order to detect the length of the recording medium and the trailing edge of the recording medium. Due to this operation, the printing operation cannot be speedily performed. In addition, if the nipping of the recording medium by the pair of upstream conveyor rollers are suddenly released during the printing operation by the ink jet head, the surface of the recording medium waves and uplifts due to ink ejected onto the recording medium at high densities and the surface of the recording medium contacts the nozzle surface of the ink jet head, thereby causing degradation in the quality of the image.

The invention provides a recording medium conveying device wherein pushing of a recording medium by a pair of upstream conveyor rollers is avoided and a smooth conveyance of the recording medium is achieved, and an image forming apparatus using the recording medium conveying device.

According to one exemplary aspect of the invention, a recording medium conveying device that conveys a recording medium to a recording area, includes a pair of first conveyor rollers that are provided upstream of the recording area and convey a recording medium by nipping the recording medium therebetween, a detector that detects a position of the recording medium, a nipping force changing unit that changes the nipping force of the pair of first conveyor rollers, and a controller that controls an operation of the nipping force changing unit in accordance with the position of the recording medium detected by the detector.

BRIEF DESCRIPTION OF THE DRAWINGS

An embodiment of the invention will be described in detail with reference to the following figures wherein.

DETAILED DESCRIPTION OF PREFERRED EMBODIMENTS

An embodiment of the invention will be described with reference to FIGS. 1 to 6. In the embodiment, the invention is applied to a recording medium conveying device 3 which is provided in a printing unit 10 having an ink-jet type recording head 2, of a multifunctional apparatus 1 that has a facsimile function, a scanning function, a copying function and a printing function.

Figure 1:
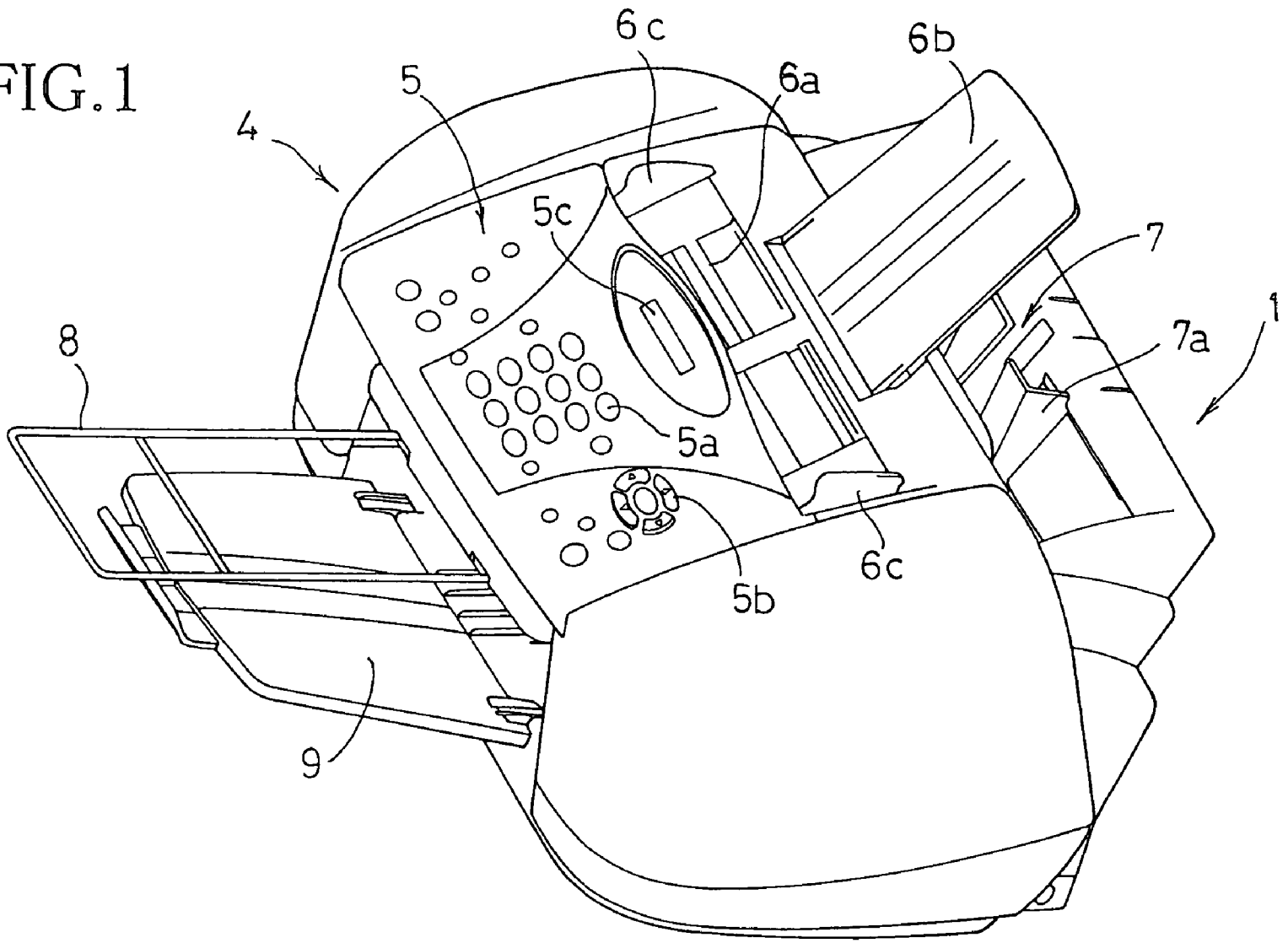
FIG. 1 is an overall perspective view of a multifunctional apparatus.

As shown in FIG. 1, a body case 4 of the multifunctional apparatus 1 is provided with an operating panel 5 at the front part of its upper surface. The operating panel 5 includes ten-digit keys 5*a* for performing the facsimile function, the scanning function and the copying function, button keys 5*b* for instructing operations, and a liquid crystal panel 5*c*. A document reader having a contact-type image sensor (not shown) is provided at the back of the operating panel 5.

The body case 4 is also provided with a document feeding portion 6*a*, behind the operating panel 5, with an upper open structure. A document rest 6*b* is provided in an inclined posture, at the rear of the document feeding portion 6*a*. The document feeding portion 6*a* includes a pair of document guide plates 6*c*, which guide side edges of a document to be fed and are movable in a right-and-left direction in synchronization with each other.

At the rear of the document rest 6*b*, a sheet feeding portion 7 is provided in an inclined posture. The sheet feeding portion 7 holds a stack of recording mediums P to be supplied to the recording medium conveying device 3 (FIG. 2) which is provided in the printing unit 10 having the recording head 2, and is mounted in the body case 4. The sheet feeding portion 7 includes a pair of recording medium guide plates 7*a*, which guide side edges of the recording mediums P and are movable in the right-and-left direction in synchronization with each other. An output document holder 8 horizontally protrudes and extends from an opening provided in the front of the body case 4 in order to hold a document outputted to the outside through the document reader. A sheet output tray 9 horizontally protrudes and extends from an opening provided in the front of the body case 4, below the output document holder 8, in order to receive a recording medium P on which an image has been formed by the printing unit.

Figure 2:
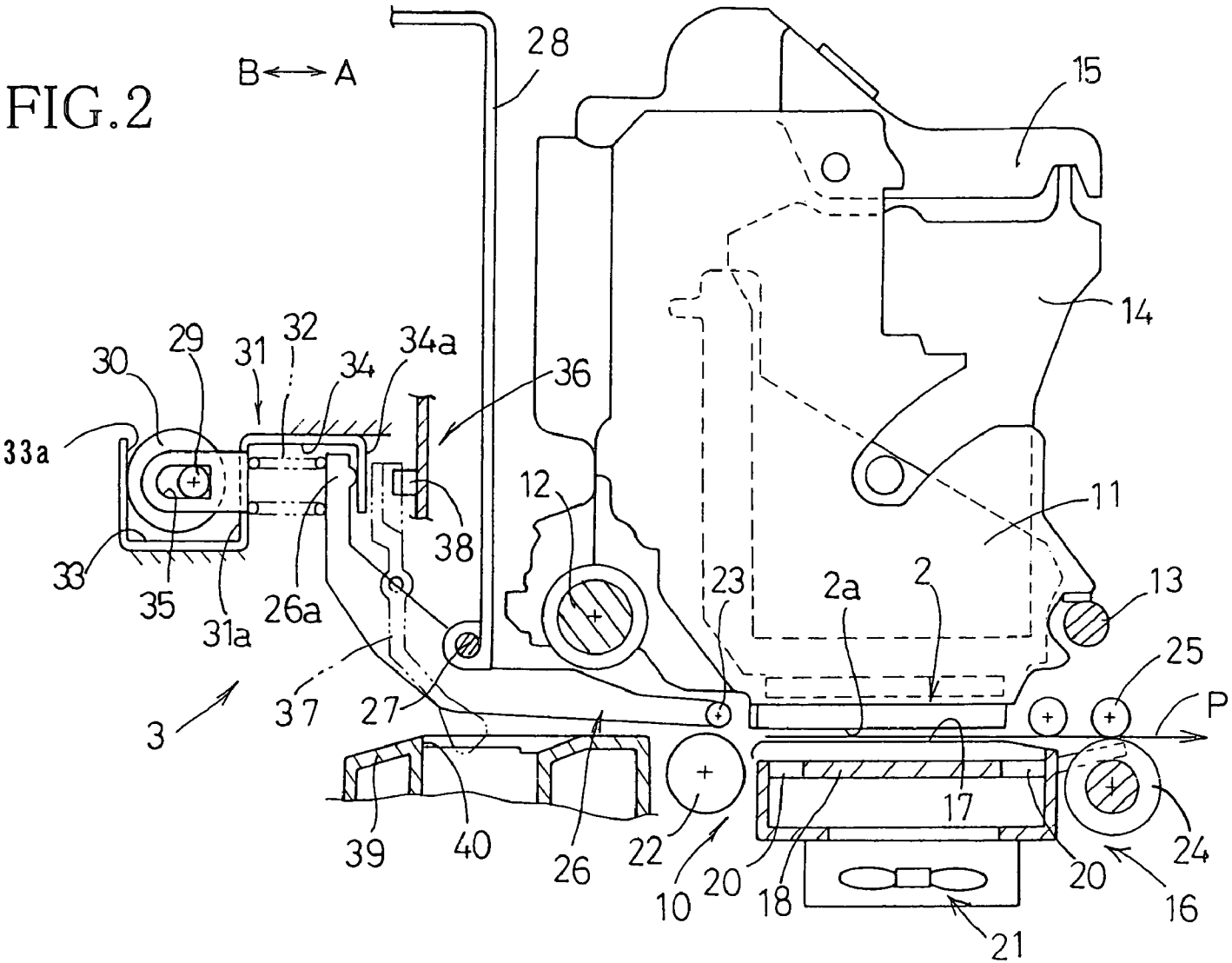
FIG. 2 is a side view of an ink-jet type printing unit and a recording medium conveying device.

FIG. 2 is a side sectional view of the recording medium conveying device 3 and the printing unit 10 including the ink jet recording head 2. In the recording medium conveying device 3, a carriage 11 is supported by guide shafts 12, 13 so as to be slidable along the guide shafts 12, 13. In FIG. 2, the guide shafts 12, 13 extend in a direction perpendicular to the surface of the drawing. Hereinafter, the direction in which the carriage 11 moves is referred to as a main scanning direction. The recording head 2, with color ink-jet type cartridges, is mounted on the carriage 11 with nozzle surface 2*a* (having a nozzle set for each ink-jet cartridge) facing downward. Ink cartridges 14, each of which stores ink of the respective colors, such as cyan ink, yellow ink, magenta ink, and black ink, are detachably/attachably mounted on the upper surface of the recording head 2. The ink cartridges 14 are downwardly pressed and fixed by respective levers 15 which can rotate in an up-and-down direction at an upper end of the carriage 11.

Figure 5:
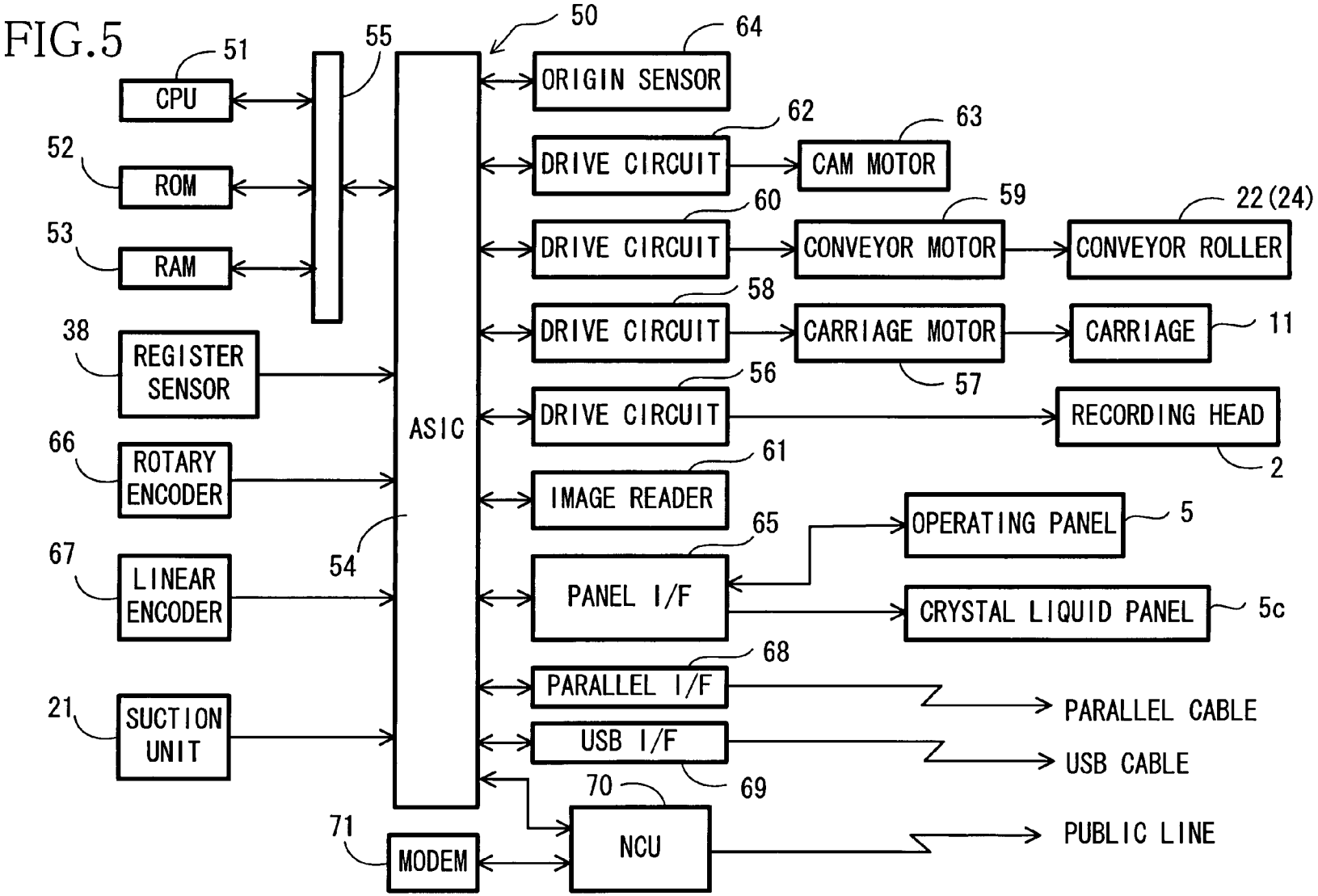
FIG. 5 a functional block diagram of a controller.

The carriage 11 is connected to an endless timing belt (not shown), which is parallel to the guide shaft 12 and can reciprocate in the main scanning direction by activation of a carriage motor 57 (FIG. 5).

Figure 4:
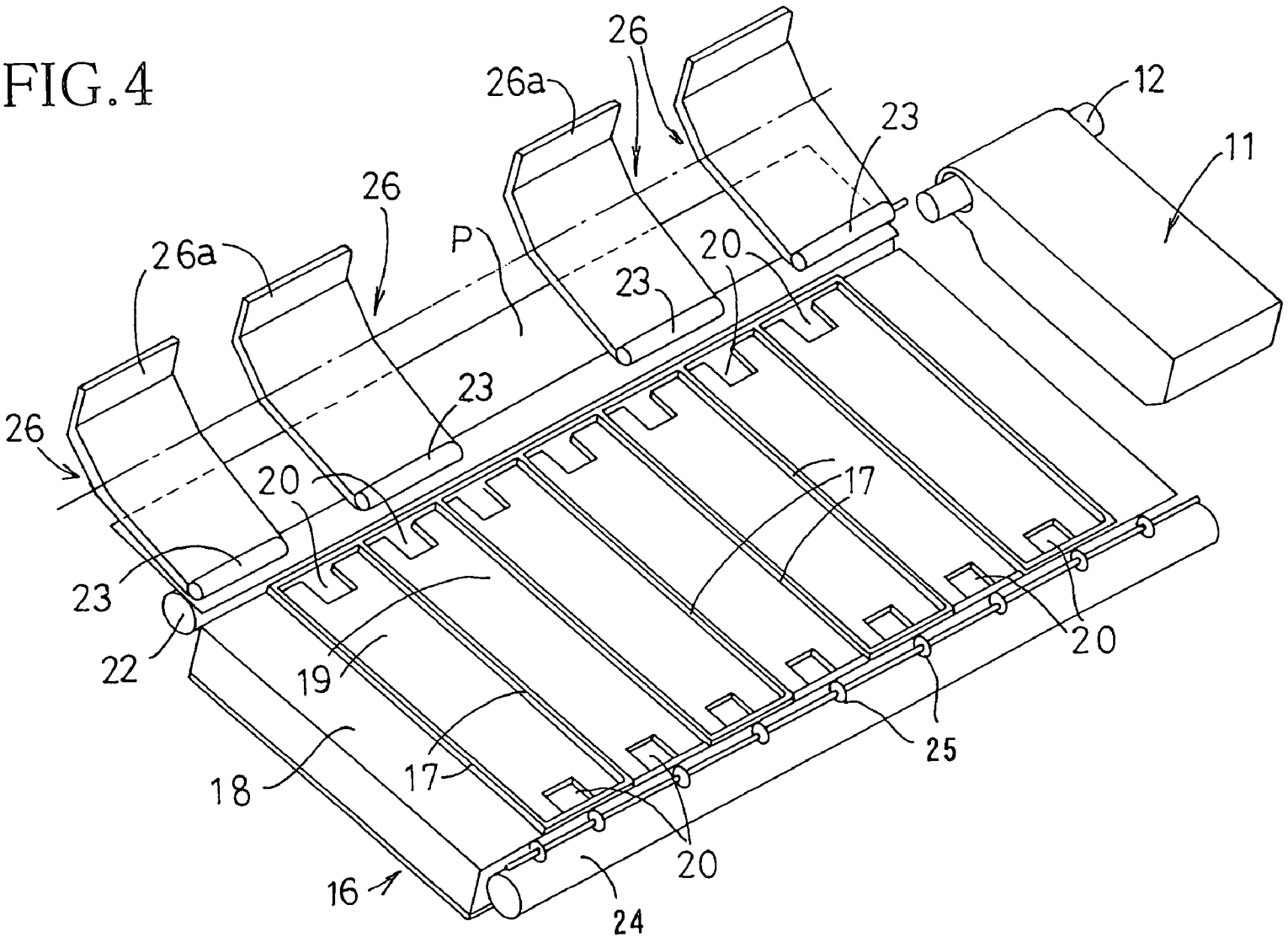
FIG. 4 is a perspective view of a suction-type platen and the recording medium conveying device.

A platen 16 is disposed below the carriage 11 so as to extend in the main scanning direction and to be opposite to the nozzle surface 2*a* of the recording head 2. As shown in FIGS. 2 and 4, the platen 16 includes a box-shaped frame whose upper surface includes a flat upper plate 18 opposed to the nozzle surface 2*a* of the recording head 2. The upper plate 18 is integrally provided with a plurality of ribs 17, which protrude from the upper surface of the upper plate 18 and extend in a recording medium conveying direction (hereinafter, referred to as a sub-scanning direction), perpendicular to the main scanning direction, at predetermined intervals provided therebetween in the main scanning direction. The upper plate 18 and the ribs 17 define a plurality of grooves 19 (FIG. 4) extending in a direction parallel to the recording medium conveying direction (sub-scanning direction). In each of the grooves 19, suction holes 20 are provided in upstream and downstream end portions with respect to the recording sheet conveying direction so as to communicate with the lower portion of the frame. The suction holes 20 are provided in the upstream and downstream end portions near an image forming area defined by the recording head 2. The box-shaped frame of the platen 16 constitutes a suction chamber. A suction unit 21, such as a suction fan, is connected to a lower portion of the suction chamber.

Next, the recording medium conveying device 3 will be described. The recording medium conveying device 3 includes a pair of upstream conveyor rollers 22, 23 and a pair of downstream conveyor rollers 24, 25, in order to intermittently convey a recording medium P, which is supplied by a sheet supply roller and a separation pad (both not shown) provided in the sheet feeding portion 7, by nipping the recording sheet P therebetween. The pair of the upstream conveyor rollers 22, 23 and the pair of the downstream conveyor rollers 24, 25 are provided at upstream and downstream positions, respectively, with the platen 16 therebetween. The downstream conveyor roller 24 is a long single drive roller extending in the main scanning direction. As shown in FIG. 4, the downstream conveyor roller 25, provided above the drive roller 24, comprises a plurality of narrow roller segments, or spurs, provided at predetermined intervals therebetween in the main scanning direction. The driven roller 25 may be designed so as to press the drive roller 24 by individually urging the narrow roller segments by means of respective elastic springs.

Figure 3A:
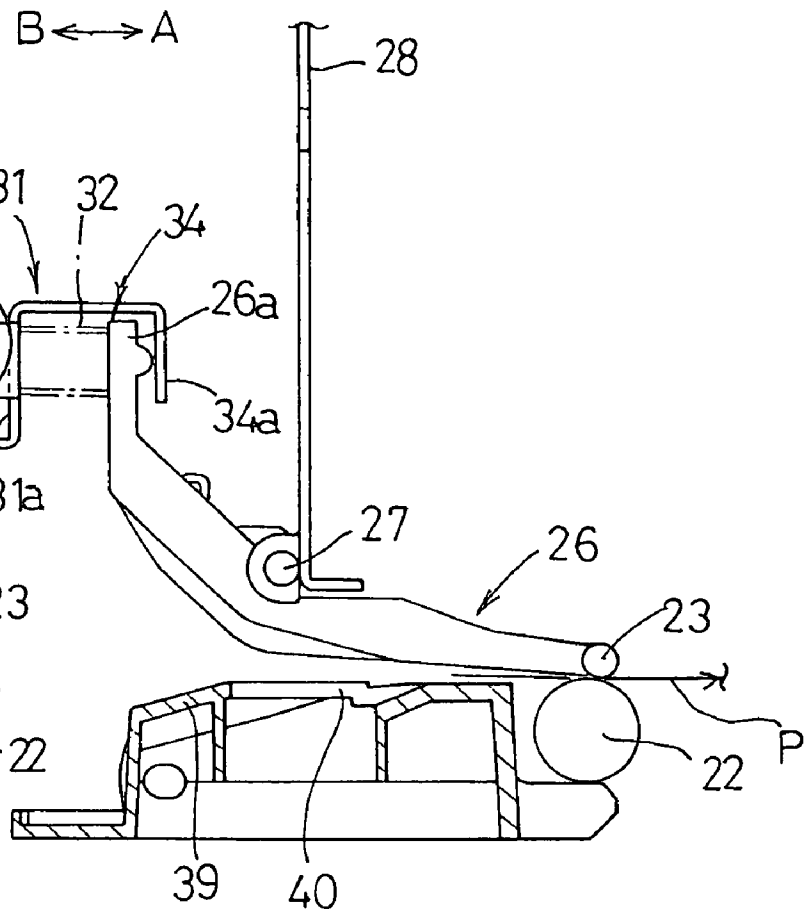
FIG. 3A is a side view showing a position of an eccentric cam when a nipping force of a pair of upstream conveyor rollers is weak.
Figure 3B:
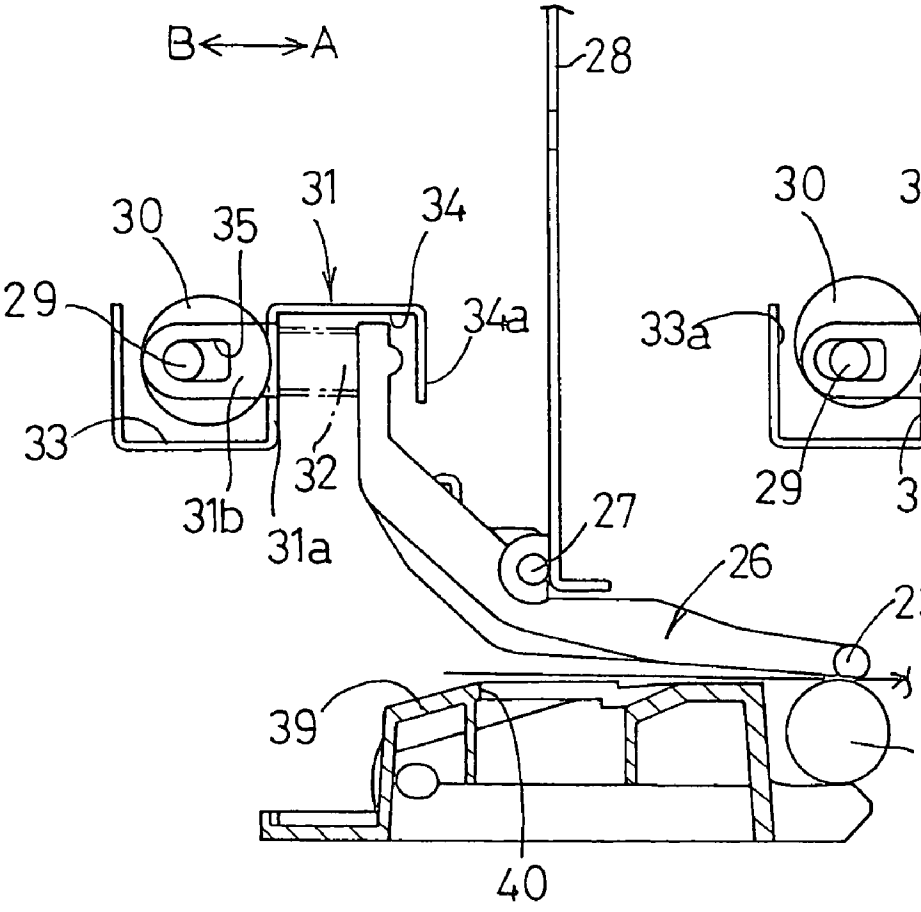
FIG. 3B is a side view showing a position of the eccentric cam when the nipping force of the pair of upstream conveyor rollers is a maximum.

The upstream conveyor roller 22 is a long single drive roller extending in the main scanning direction. As shown in FIGS. 2 to 4, the upstream conveyor roller 23 is, in the embodiment, a plurality of driven rollers 23, which are rotatably provided at end portions of respective arms 26. The driven rollers 23 and the arms 26 are provided at predetermined intervals in the main scanning direction. More particularly, as shown in FIGS. 3A and 3B, a middle portion of each of the arms 26 is rotatably supported by a support shaft 27 supported by the frame 28 provided upstream of the carriage 11 in a standing posture. Each of the arms 26 can rotate in the up-and-down direction about its middle portion. The driven rollers 23 are disposed at symmetrical positions about a center line of the recording medium P in the width direction (in the main scanning direction). The upstream and downstream drive rollers 22, 24 are synchronized with each other via the conveyor motor 59 (FIG. 5) and a power transmission mechanism (not shown) including a plurality of gears, so as to rotate in the same direction.

Next, a nipping force changing mechanism will be described. The nipping force changing mechanism changes a nipping force of the drive roller 22 and the respective driven rollers 23. Further, in the embodiment, the nipping force changing mechanism allows the driven rollers 23 to be disengaged from the drive roller 22 (or permits the nipping force to be zero (0)). As shown in FIGS. 2 to 3B, the nipping force changing mechanism includes an eccentric cam 30 fixed to a drive shaft 29, a movable body 31 moving back and forth in the sub-scanning direction, and an urging spring 32 connecting the other end (upper end) of the arm 26 with the movable body 31.

A plurality of the eccentric cams 30 are provided so as to correspond to the plurality of arms 26. For each eccentric cam 30, a movable body 31 is provided. Each of the movable bodies 31 includes a middle piece 31*a* which defines a first recessed regulating portion 33, on the one side, in which the eccentric cam 30 is provided, and a second recessed regulating portion 34, on the other side, in which the end portion 26*a* of the arm 26 and the urging spring 32 are disposed. The first regulating portion 33 opens upwardly and the second regulating portion 34 opens downwardly.

A bracket 31*b* is provided to the middle piece 31*a* of each of the movable bodies 31. The bracket 31*b* is provided with a slot 35 which extends in the sub-scanning direction and slidably guides the drive shaft 29 therein. The movable body 31 is supported by a frame so as to be able to move back and forth in the sub-scanning direction. The drive shaft 29 is connected to a cam motor 63 (FIG. 5). The plurality of eccentric cams 30 attached to the drive shaft 29 are rotated simultaneously by the driving of the cam motor 63.

As shown in FIGS. 2 to 3B, the position of the movable body 31 is changed with the variations in the rotational phase of the eccentric cam 30, whereby the nipping force of the driven roller 23 and the drive roller 22 is changed. For example, as shown in FIG. 2, in order to locate the eccentric cam 30 at a maximum eccentric position on an arrow B side, a substantially vertically standing contacting piece 33*a* opposite to the middle piece 31*a* of the movable body 31 is pushed a maximum distance in the direction indicated by the arrow B by the peripheral surface of the eccentric cam 30, and thus, the whole movable body 31 moves in the arrow B direction by the maximum distance in the first regulating portion 33.

Therefore, the end portion 26*a* of the arm 26, fitted in the second regulating portion 34, is pushed in the arrow B direction by a contacting piece 34*a* of the second regulating portion 34. Thus, the portion of the arm 26, holding driven roller 23, is upwardly rotated so as to separate the driven roller 23 from the drive roller 22.

As shown in FIG. 3B, in order to locate the eccentric cam 30 at a maximum eccentric position shown by arrow A, the peripheral surface of the eccentric cam 30 contacts and pushes the middle piece 31*a* of the movable body 31 in the arrow A direction by a maximum distance. That is, the whole movable body 31 moves in the arrow A direction by the maximum distance. At that time, the end portion 26*a* of the arm 26 pressed by the urging spring 32 is pushed in the arrow A direction in the second regulating member 34 without contacting the contacting piece 34*a*. With this movement, the arm 26 downwardly rotates so that the driven roller 23 contacts and presses the drive roller 24 with a maximum pressure. Accordingly, in this state, the nipping force applied to the recording medium P by the driven roller 23 and the drive roller 22 is at a maximum strength.

The state shown in FIG. 3A is a condition between the state of FIG. 2 and the state of FIG. 3B. The eccentric cam 31 presses the middle piece 31*a* of the movable body 31 in the arrow A direction at its peripheral surface at a position at which the eccentric amount of the cam 30 is smaller than the maximum eccentric position. The end portion 26*a* of the arm 26 is pressed by the urging spring 32 in the second regulating portion 34 and stably pushed against the contacting piece 34*a*. In this state, the force of nipping the recording medium P by the driven roller 23 and the drive roller 22 is a value proportional to the rotational phase of the eccentric cam 30.

As described above, because the nipping force changing mechanism includes the eccentric cams 30, the movable bodies 31, the arms 26, and the urging springs 32, a structure for changing the nipping force of the upper conveyor rollers 22, 23, step by step (a plurality of steps of at least two steps), can be easily realized. In addition, the fine adjustment of the changing amount can be very easily performed.

An origin sensor 64 (FIG. 5) is provided to detect an origin point of the eccentric cam 30 (for example, the state of FIG. 2 is referred to as a standard position). The cam motor 63, as a stepping motor, is set so that the nipping force changing mechanism moves to the state shown in FIG. 3B or 3A when the cam motor 63 rotates a predetermined stepping number of times in a predetermined direction after the origin sensor 64 detects the origin point.

In order to give variety in the eccentricities with respect to the rotational phases of the eccentric cams 30, the phase of the eccentric cams attached to the respective drive shaft 29 or the shape of the eccentric cams 30 can be changed depending on the positions of the driven rollers 23, when a plurality of driven rollers 23 are provided. For example, it is possible to provide a design such that the nipping forces are first released at the each side of the recording medium P in the sheet width direction and the nipping forces are then released at the portions near the center of the recording medium in the sheet width direction.

A detecting mechanism 36 is provided near to and upstream of, the upstream conveyor rollers 22, 23. The detecting mechanism 36 detects a leading edge of a recording medium P being fed and that the nipping of the recording medium P by the upstream conveyor rollers 22, 23 will be released at a next intermittent conveyance. The detecting mechanism 36 includes a rotating lever 37, shown by a double dot and dashed line in FIG. 2, and a register sensor 38, such as a photointerrupter, that detects an approach of a base end of the rotating lever 37 with respect to the detecting mechanism 36. When a free end (lower end) of the rotating lever 37 is positioned in an opening 40 provided in an upper surface of a guide plate 39 (in a state where a trailing edge of the recording medium P has passed over the guide plate 39), the base end of the rotating lever 37 is located at a position close to the register sensor 38, so that the detecting mechanism 36 outputs an on signal. In a state where the free end of the rotating lever 37 is upwardly rotated by the leading edge of the recording medium P, the base end of the rotating lever 37 moves away from the register sensor 38, so that the detecting mechanism 36 outputs an off signal.

FIG. 5 is a functional block diagram of a controller 50, which controls a recording medium conveying operation. The controller 50 includes a microcomputer including a CPU 51, a ROM 52, and a RAM 53 and is connected to an ASIC (Application Specific Integrated Circuit) 54. The controller 50 controls all operations of the multifunctional apparatus 1 as well as the recording medium conveying operation. In the controller 50, the CPU 51, which performs various calculations and controls, the ROM 52, which stores programs and parameters required for control by the CPU 51, the RAM 53, which stores image data and various data, such as an LF correction value and an EX correction value, and the ASIC 54 are connected with each other via a bus 55.

The ASIC 54 is connected with a drive circuit 56 for the recording head 2, a drive circuit 58 for the carnage motor 57, a drive circuit 60 for a conveyor motor 59 for conveying a recording medium P, an image reader 61, a drive circuit 62 for the cam motor 63, the cam origin sensor 64, a panel interface 65 for the operating panel 5 and the crystal liquid panel 5*c*, the register sensor 38 that detects leading and trailing edges of a recording medium P, a rotary encoder 66 that counts a length of the recording medium conveyed by the upstream conveyor rollers 22, 23, a linear encoder 67 that detects a moving distance and a moving direction of the carriage 11, a suction unit 21, such as the suction fan, that sucks air existing in the platen 16, a parallel interface 68 that inputs and outputs image data to and from an external device, such as a personal computer, a USB interface 69 that inputs and outputs image data to and from an external device, such as a digital camera, and a network control unit (NUC) 70 and a modem 71 that enables the transmittal of data through an external facsimile and a general public line.

Figure 6:
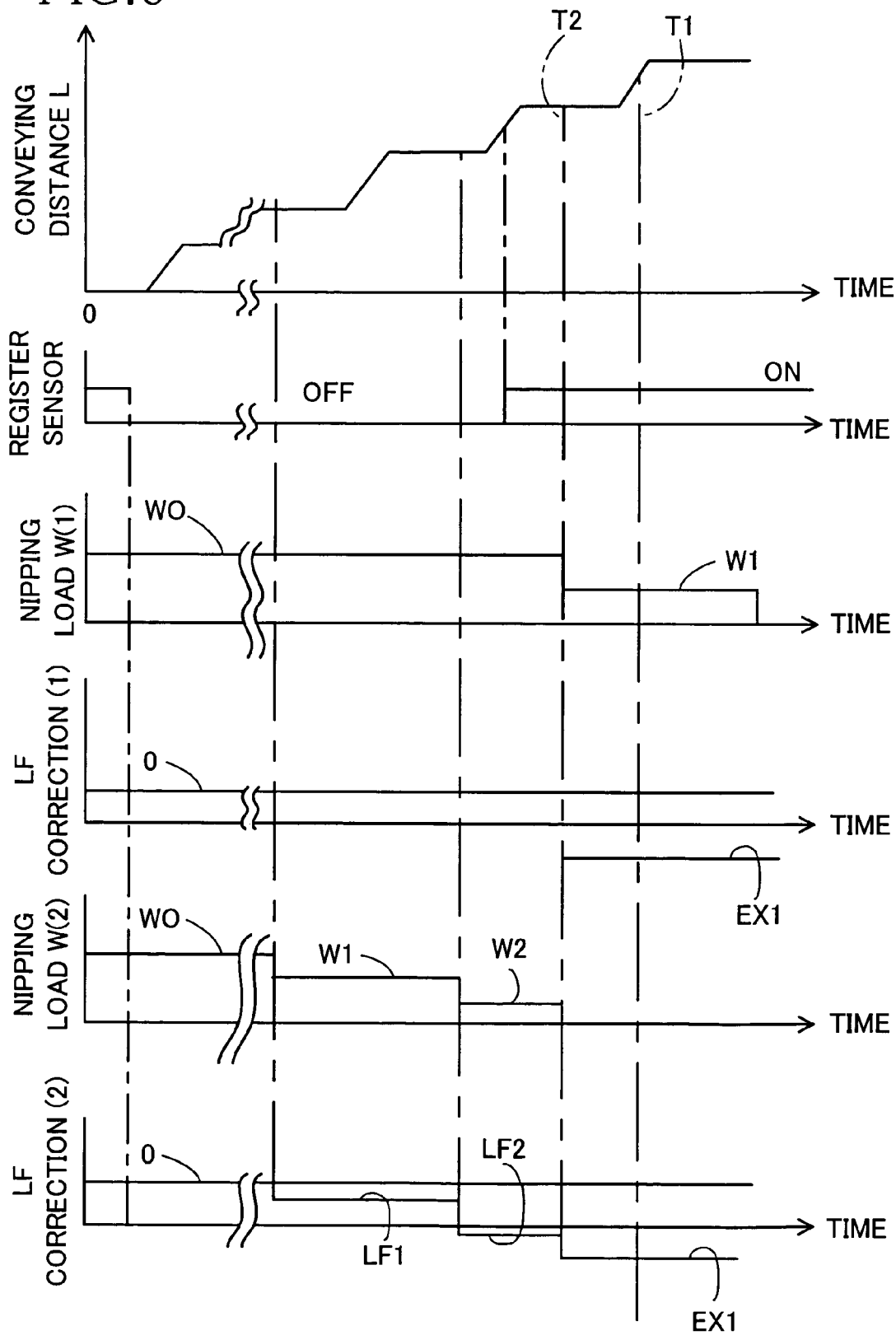
FIG. 6 is a time chart showing a control of changing the nipping force of the upstream conveyor rollers.

Control of the changing and releasing of the nipping force of the pair of upstream conveyor rollers 22, 23 will be described with reference to the timing chart of FIG. 6. As an instruction for forming an image (printing) is issued by operating buttons provided in the operating panel 5, a topmost recording medium P is separated from the stack in the sheet feeding portion 7 and is fed toward the lower edge of the rotating lever 37 (FIG. 2) by the rotation of the sheet supply roller (not shown). When a leading edge of the recording medium P pushes upward the rotating lever 37, the register sensor 38 outputs an off signal. Then, the cam motor 63, as a stepping motor, is driven by the predetermined number of steps to rotate the eccentric cams 30 so that the cams 30 move to the state shown in FIG. 3B, and the driven rollers 23 provided at the ends of the arms 26 are pressed against the drive roller 22 from above, at the upstream side in the conveying direction. At this point, the drive roller 22 is not driven and is at a standstill. In this state, the recording medium P is conveyed by a predetermined distance by the sheet supply roller until the leading edge of the supplied recording medium P abuts against the nipping points of the plurality of driven rollers 23 and the drive roller 22, so that the leading edge of the recording medium P is held in a posture parallel to the main scanning direction. Then, the leading edge of the recording medium P is nipped at the nipping points between the plurality of driven rollers 23 and the drive roller 22 (a nipping load W0 at an early condition, see FIG. 6) by driving the drive roller 22 and stopping (releasing) of the sheet supply roller, and the upstream drive roller 22 and the downstream drive roller 24 are intermittently driven in synchronization with each other.

The recording head 2 is provided with nozzles for ejecting ink droplets (not shown), in rows, at predetermined intervals, in the sub-scanning direction. The recording head 2 forms an image in an area having a predetermined printing width by moving in the main scanning direction along the guide shafts 12, 13. While the recording head 2 is moving in the main scanning direction to perform printing, the drive rollers 22, 24 are not driven. When the recording head 2 is not driven, the drive rollers 22, 24 are driven. That is, the movement of the recording head 2 and the printing operation, and the driving of the drive rollers 22, 24 are alternately performed, thereby intermittently driving the drive rollers 22, 24.

While the recording medium P is supplied and ejected on the output tray 9, the suction unit 21 is activated. When the suction unit 21 is activated, air is sucked from the upstream and downstream sides of the platen 16 through the grooves 19 provided therein, so that the supplied recording medium P does not lift toward the recording head 2. Accordingly, the recording medium P is levelly supported on the upper surfaces of the ribs 17 of the platen 16 and a distance between the recording medium P and the nozzle surface 2*a* of the recording head 2 is maintained constant at all times.

As described above, in the state where the suction unit 21 is activated, the intermittent driving is repeated. More particularly, the intermittent driving is as described below. The recording head 2 is driven with moving the carriage 11 in the main scanning direction while the conveyance of the recording medium P is temporarily stopped. While doing so, ink droplets are selectively ejected from the nozzles to form an image in a predetermined area. After that, the recording medium P is conveyed in the sub-scanning direction by a predetermined distance and then the conveyance of the recording medium P is stopped and an image is formed by moving the carriage 11.

The pair of downstream conveyor rollers 24, 25 and the pair of upstream conveyor rollers 22, 23 are synchronized such that the conveying speed of the pair of downstream conveyor rollers 24, 25 is slightly faster than the conveying speed of the pair of upstream conveyor rollers 22, 23. However, because the nipping force of the pair of downstream conveyor rollers 24, 25 is weaker than the nipping force of the pair of upstream conveyor rollers 22, 23, the recording medium P slips to some extent at the nipping points of the pair of downstream conveyor rollers 24, 25 even though the drive rollers 22, 24 are synchronously driven. Thus, the flatness of the recording medium P is maintained on the platen 16. That is, it is designed such that the conveying distance of the recording medium P by the downstream conveyor rollers 24, 25 is larger than the conveying distance by the upstream conveyor rollers 22, 23 in order to prevent warping of the recording medium P.

A recording medium edge detecting position of the rotational lever 37 is provided upstream from the pair of the upstream conveyor rollers 22, 23. The detection of the passage of the trailing edge of the recording medium P can be detected by a detection value (on, off) of the register sensor 38. A distance of travel in the conveying direction (the sub-scanning direction) of the recording medium P provided by the upstream conveyor rollers 22, 23 at each intermittent movement and a cumulative travel distance (a travel distance L, see FIG. 6) can be calculated by detection values of the rotary encoder 66. Therefore, a moving timing T1 at which the trailing edge of the recording medium P comes out of the nipping points of the upstream conveyor rollers 22, 23 in the discharge direction can be also determined by the detection values of the rotary encoder 66. More particularly, the controller 50 calculates a time at which a conveying distance of the recording medium P exceeds a predetermined value (a distance between the attaching position of the rotary lever 37 and the position of the upstream conveyor rollers 22, 23) after the register sensor 38 detects the trailing edge of the recording medium P (switches an off signal to an on signal). When a type of recording medium P to be used is known in advance, the length is also known and a timing at which the cumulative travel distance L exceeds the length of the recording medium P after the register sensor 38 detects the leading edge of the recording medium P (switches an on signal to an off signal) may be calculated.

By providing the detecting mechanism 36, which detects the leading and trailing edges of the recording medium P, at the position upstream of the upstream conveyor rollers 22, 23, the detecting mechanism 36 can very easily detect that the recording medium P will come out of the nipping points of the upstream conveyor rollers 22, 23 at a next intermittent conveyance.

Accordingly, the timing T1 at which the recording medium P comes out of the nipping points of the upstream conveyor rollers 22, 23 at a next intermittent conveyance (see FIG. 6) is determined. At a timing T2, which occurs while the conveyance of the recording medium P is stopped and which is an appropriate time period prior to the timing T1, the cam motor 60 is driven by the drive circuit 62 in order to bring the cams 30 into the phase of FIG. 2 or 3A. In the state shown in FIG. 2, the driven roller 22 is disengaged from the drive rollers 23 by rotating the arms 26 so that the nipping force W of the pair of upstream conveyor rollers 22, 23 becomes 0 (zero). In the state shown in FIG. 3A, the movable bodies 31 move leftward in the drawing, so that the urging force of the urging springs 32 become weak. Thus, the nipping force W reduces to W1 (see the right part of the nipping load (1) in FIG. 6). The nipping force W1 is set to weaken enough so that the upstream conveyor rollers 22, 23 do not interrupt the conveyance of the recording medium P by the downstream conveyor rollers 24, 25.

As described above, during the intermittent movement immediately before the trailing edge of the recording medium P comes out of the nipping points of the upstream conveyor rollers 22, 23, the nipping force W of the upstream conveyor rollers 22, 23 is reduced to zero or W1. That is, when the controller 50 determines that the recording medium P will be conveyed by the downstream conveyor rollers 24, 25 only by a next driving of the upstream conveyor rollers 22, 23, the controller 50 releases the nipping force of the upstream conveyor rollers 22, 23 or reduces the nipping force to a force smaller than the maximum force that the upstream conveyor rollers 22, 23 can exert on the recording medium P, by rotation of the eccentric cams 30. With this structure, the recording medium P is prevented from being pushed when the trailing edge of the recording medium P comes out of the nip of the upstream conveyor rollers 22, 23. Even when the pushing of the recording medium happens, this situation can be restricted to a minimum amount. Accordingly, the situation such that the recording medium P advances beyond the nipping force provided by the downstream conveyor rollers 24, 25 can be prevented.

However, as described above, the sheet conveying distance of the pair of downstream conveyor rollers 24, 25 is set to be larger than the sheet conveying distance of the pair of upstream conveyor rollers 22, 23, in order to prevent the recording medium P from deforming or waving. Therefore, in this case, the sheet conveying distance will be longer than usual. Thus, it is necessary to perform a correction when the recording medium P is conveyed by the pair of downstream conveyor rollers 24, 25 only.

In the above case, by performing an LF correction (1), in which a correction value of an intermittent conveying distance (EX distance) by the downstream conveyor rollers 24, 25 is changed from an initial value (zero) to a proper value (EX1), concurrently with the control of reducing the nipping force W (see FIG. 6), the conveyance of the recording medium P can be smoothly switched to the downstream conveyor rollers 24, 25. The proper value (EX1) is a correction value that corresponds to a difference of the sheet conveying distance between the upstream conveyor rollers 22, 23 and the downstream conveyor rollers 24, 25.

With the above control, an image dropout (i.e. so-called white lines) can be prevented from occurring in a recording image, so that deterioration of the image can be positively prevented and excellent image quality can be assured.

Another embodiment of the control of changing the nipping load W will be described. As shown in the nipping load (2) of FIG. 6, the changing of the nipping load W may be performed by several steps, for example, two steps or more, corresponding to the intermittent conveyance. That is, at the several intermittent conveyances before the trailing edge of the recording medium P comes out of the nipping points of the pair of upstream conveyor rollers 22, 23, the nipping load W (nipping force) is controlled so as to become smaller step-by-step at the approach to the time period when the recording medium P comes out of the nipping points (W0=>W1=>W2). In order to do so, cam motor 63 is driven by an appropriate stepping number of times so as to change the rotational phases of the eccentric cams 30 in order to reduce the nipping force of the pair of upstream conveyor rollers 22, 23, step-by-step. By doing so, pushing of the recording medium P can be prevented when the trailing edge of the recording medium P comes out of the upstream conveyor rollers 22, 23. When the nipping load W (nipping force) of the upstream conveyor rollers 22, 23 is reduced in several steps, that is, two steps or more, slippage error of the recording medium P can be reduced to a minimum.

In each embodiment, concurrently with the control of reducing the nipping force W, an LF correction (2) is preformed. In the LF correction (2), a correction value of a conveying distance (LF distance) at an intermittent conveyance is changed from an initial value (zero) to a proper value (LF1 to LF2), step by step, with each conveyance by the upstream conveyor rollers 22, 23. After the time T2, which is a time before the trailing edge of the recording medium P comes out of the nip of the upstream conveyor rollers 22, 23, the rollers for conveying the recording medium P can be smoothly switched to the downstream conveyor rollers 24, 25 by adopting the EX correction value (EX1) so that the sheet conveying distance of the upstream conveyor rollers 22, 23 is corrected so as to be equal to the sheet conveying distance of the downstream conveyor rollers 24, 25 (FIG. 6).

In the above-described embodiments, the air-suction type platen 16 is used. Therefore, the trailing edge of the recording medium P does not come off the upper surface of the platen 16 after the trailing edge of the recording medium P is released from the nipping points of the upstream conveyor rollers 22, 23. Accordingly, the trailing edge of the recording medium does not contact or slide over the nozzle surface 2*a*. Thus, even if the edge portion of the recording medium P is curled, the image quality can be maintained.

The nipping force changing unit can be structured as described below. The upstream drive roller 22 can be supported so as to move close to and away from the upstream driven rollers 23, and urging springs (a coil tension spring, a compression spring, or a torsion spring) that exert their force in an urging direction is provided to the arms 26. The nipping force of the pair of upper conveyor rollers 22, 23 can be changed by adjusting the positions of the end portions 26*a* of the arms 26 via the respective eccentric cams 30.

As shown in FIGS. 2, 3A, and 3B, when the driven rollers 23 are maintained separated from the drive roller 22 by the contacting pieces 34*a* of the respective movable bodies 31, it is unnecessary to provide a separated actuator to drive the movable bodes 31, so that the structure of the pinching force changing unit is simplified.

With the structure described above, based on the position of the recording medium P, detected by the detecting mechanism 36, the operation of the nipping force changing mechanism is controlled to change the nipping force of the recording medium P by the upstream conveyor rollers 22, 23. Therefore, the nipping force of the upstream conveyor rollers 22, 23 is not suddenly released (does not suddenly drop to zero) and the recording medium P can be smoothly conveyed.

The detecting mechanism 36 detects the distance from the pair of upstream conveyor rollers 22, 23 to the trailing edge of the recording medium P. Therefore, it is unnecessary to perform a normal rotation and reverse rotation of the upstream and downstream conveyor rollers, 22, 23, 24, 25 as done in the conventional manner. Thus, an image forming operation can be speedily performed.

The controller 50 allows the nipping force changing mechanism to reduce the nipping force of the upstream conveyor rollers 22, 23, step by step, based on the detection result of the detecting mechanism 36. Accordingly, the pushing of the recording medium P by the upstream conveyor rollers 22, 23 can be further effectively prevented.

In addition, the conveyor motor 59 for driving the upstream conveyor rollers 22, 23 is provided. The controller 50 controls the conveyor motor 59 to intermittently drive the conveyor rollers. While the conveyor rollers are not driven, the nipping force changing mechanism changes the nipping force of the upstream conveyor rollers 22, 23. Therefore, the pushing of the recording medium P by the upstream conveyor rollers 22, 23 can be further effectively prevented as compared with a case where the nipping force is changed during the intermittent conveyance of the recording medium P.

It is preferable that the plurality of driven rollers 23 are provided so as to align in a direction perpendicular to the sheet conveying direction and to be symmetrical around a center line of the recording medium P and the nipping force of the recording medium P by the drive and driven rollers 22, 23 be reduced by the nipping force changing unit, wherein the nipping force of the drive and driven rollers 22, 23, located at positions far from the center line of the recording medium P, is reduced prior to the drive and driven rollers 22, 23 located at positions near the center line of the recording medium P. By doing so, the skewing of the recording medium P can be further restricted when the recording medium P is nipped and conveyed by the downstream conveyor rollers 24, 25 only, after the trailing edge of the recording medium P comes out of the upstream conveyor rollers 22, 23.

The invention is not limited to the recording medium conveying device that conveys a recording medium to the printing unit having the ink-jet recording head 2, but also can be applied to a recording medium conveying device that conveys a recording medium to a printing unit of any type, for example, a printing unit having a thermal head or an electrophotographic printing unit.

Further, the invention can be applied to a recording medium conveying device of a document reader provided in a facsimile machine and a scanning device as well as the recording medium conveying device disposed at the position opposite to the recording head. In this case, also, the pushing of the recording medium P by the upstream conveyor rollers 22, 23 can be prevented. Consequently, an image can be stably read after the trailing edge of the recording medium P passes the nipping points of the upstream conveyor rollers 22, 23, so that the read image data can be prevented from being distorted.

The way of conveying the recording medium P is also not limited to the intermittent conveyance as described above. The recording medium P can be continuously conveyed. However, in the conveying device that continuously conveys the recording medium P, it is necessary to control the nipping force of the upstream conveyor rollers so that the nipping force is reduced step by step. In order to achieve a smooth conveyance of a recording medium, it is preferable that the nipping force is reduced by several steps as much as possible.

Although the invention has been described in detail with reference to a specific embodiment thereof, it would be apparent to those skilled in the art that various changes, arrangements and modifications may be applied therein without departing from the spirit and scope of the invention.

What is claimed is:

1. A recording medium conveying device that conveys a recording medium to a recording area, comprising:

a pair of first conveyor rollers that are provided upstream of the recording area and convey a recording medium by nipping the recording medium therebetween;

a detector that detects a position of the recording medium;

a nipping force changing unit that changes a nipping force of the pair of first conveyor rollers; and a controller that controls an operation of the nipping force changing unit in accordance with the position of the recording medium detected by the detector, wherein the nipping force changing unit includes:

a cam member;

a cam follower that contacts with the cam member, the cam follower including a middle piece that defines a first recessed regulating portion in which the cam is disposed, and a second recessed regulating portion in which an end portion of the arm and spring are disposed;

a spring that contacts with the cam follower, the cam follower being disposed between the cam member and the spring; and an arm that includes a receive portion and a roller holder portion, the receive portion receiving a force related to a position of the cam follower via the spring, and the roller holder portion holding a one of the pair of first conveyor rollers; and a support shaft that rotatably supports the arm.

2. The recording medium conveying device according to claim 1, wherein the detector detects the position of the recording medium in accordance with a distance that the recording medium is conveyed by the pair of the first conveyor rollers.

3. The recording medium conveying device according to claim 1, wherein the detector detects a distance from the pair of first conveyor rollers to the trailing edge of the recording medium.

4. The recording medium conveying device according to claim 1, wherein the controller allows the nipping force changing unit to reduce the nipping force of the pair of first conveyor rollers, step by step, in accordance with a detection result of the detector.

5. The recording medium conveying device according to claim 1, further comprising a driver that drives the pair of first conveyor rollers, wherein the controller controls the driver so as to intermittently drive the pair of first conveyor rollers.

6. The recording medium conveying device according to claim 5, wherein the controller allows the nipping force changing unit to change the nipping force while the pair of first conveyor rollers are not driven.

7. The recording medium conveying device according to claim 5, further comprising a pair of second conveyor rollers that are provided downstream of the pair of first conveyor rollers and convey the recording medium, which is conveyed from the pair of first conveyor rollers, by nipping the recording medium therebetween, wherein the driver drives the pair of second conveyor rollers together with the pair of first conveyor rollers.

8. The recording medium conveying device according to claim 7, further comprising a condition change determining unit that determines whether a current condition is going to be changed by a next intermittent driving of the pair of first conveyor rollers performed by the driver, from a condition where the recording medium is conveyed by both the pairs of first and second conveyor rollers to a condition where the recording medium is conveyed by the pair of the second conveyor rollers only, wherein when the condition change determining unit determines that the current condition is going to be changed to the condition where the recording medium is conveyed by the pair of the second conveyor rollers only, the controller reduces the nipping force of the pair of first conveyor rollers during the next intermittent driving of the first conveyor rollers, by means of the nipping force changing unit.

9. The recording medium conveying device according to claim 8, wherein the nipping force changing unit releases the recording medium from the nipping force of the pair of first conveyor rollers or reduces the nipping force of the pair of first conveyor rollers to a strength smaller than a maximum conveying force of the pair of first conveyor rollers that can be transmitted to the recording medium.

10. The recording medium conveying device according to claim 8, wherein the controller corrects the conveying distance of the recording medium by the pair of second conveyor rollers when the recording medium is released from the nipping of the pair of first conveyor rollers.

11. The recording medium conveying device according to claim 1, wherein the pair of first conveyor rollers and the nipping force changing unit includes a plurality of pairs of first conveyor rollers and nipping force changing units which are disposed in a direction perpendicular to a recording medium conveying direction, and the controller controls each of the nipping force changing units such that nipping forces of all the nipping force changing units are the same strength.

12. The recording medium conveying device according to claim 11, wherein the plurality of pairs of first conveyor rollers and the plurality of nipping force changing units are disposed in a direction perpendicular to a recording medium conveying direction, and symmetrical with respect to a center line of the recording medium in a width direction of the recording medium, and the controller allows the nipping force changing unit to reduce the nipping force of a pair of first conveyor rollers disposed at a position further from a center of the recording medium in the width direction, prior to a pair of first conveyor rollers disposed at a position near the center of the recording medium.

13. The recording medium conveying device according to claim 1, wherein the spring is disposed between the cam follower and the receive portion.

14. The recording medium conveying device according to claim 1, wherein the receive portion is disposed at an end of the arm.

15. The recording medium conveying device according to claim 1, wherein the cam member includes an eccentric cam.

16. The recording medium conveying device according to claim 1, wherein the cam follower moves in an urging direction substantially perpendicular to a plane which includes both axes of the pair of first conveyor rollers.

17. The recording medium conveying device according to claim 1, wherein the support shaft supports a portion disposed between the receive portion and the roller holder portion.

18. The recording medium conveying device according to claim 1, further comprising a stopper that limits the movement of the arm.

19. The recording medium conveying device according to claim 1, further comprising: the cam follower fixed to a drive shaft, and a bracket that includes a slot extending in a sub-scanning direction, parallel to the feed direction of the print medium, that slidably guides the drive shaft.

20. A recording medium conveying device that conveys a recording medium to a recording area, comprising:

a pair of first conveyor rollers that are provided upstream of the recording area and convey a recording medium by nipping the recording medium therebetween;

a detector that detects a position of the recording medium;

a nipping force changing unit that changes the nipping force of the pair of first conveyor rollers;

a controller that controls an operation of the nipping force changing unit in accordance with the position of the recording medium detected by the detector; and a driver that drives the pair of first conveyor rollers, wherein the controller controls the driver so as to intermittently drive the pair of first rollers, and a conveying distance of the recording medium by the pair of first conveyor rollers at an intermittent conveyance is gradually reduced proportional to an advance of the recording medium.

21. A recording medium conveying device that conveys a recording medium to a recording area, comprising:

a pair of first conveyor rollers that are provided upstream of the recording area and convey a recording medium by nipping the recording medium therebetween;

a detector that detects a position of the recording medium;

a nipping force changing unit that changes a nipping force of the pair of first conveyor rollers; and a controller that controls an operation of the nipping force changing unit in accordance with the position of the recording medium detected by the detector, wherein the nipping force changing unit includes:

a cam member;

a cam follower that contacts with the cam member;

a spring that contacts with the cam follower; and an arm that includes a receive portion and a roller holder portion, the receive portion receiving a force related to a position of the cam follower via the spring, and the roller holder portion holding a one of the pair of first conveyor rollers;

a support shaft that rotatably supports the arm; and a stopper moveable between a first position at which the stopper contacts with the arm and a second position at which the stopper does not contact with the arm, the stopper limiting a position of the arm when the stopper is at a first position.

22. The recording medium conveying device according to claim 21, wherein the cam follower includes the stopper.

23. The recording medium conveying device according to claim 21, wherein the second position of the stopper causes one conveyor roller of the pair of first conveyor rollers to be held away from the other conveyor roller of the pair of first conveyor rollers.

* * * * *